US005384938A

United States Patent [19]

Frederick

[11] Patent Number: 5,384,938

[45] Date of Patent: Jan. 31, 1995

[54] DINNERWARE SECUREMENT ASSEMBLY

[76] Inventor: Darrel L. Frederick, 13303 Mt. Baldy, Reno, Nev. 89506

[21] Appl. No.: 27,700

[22] Filed: Mar. 8, 1993

[51] Int. Cl.[6] ..... A44B 21/00; A47G 19/00

[52] U.S. Cl. ..... 24/306; 24/3 L; 24/563; 211/41

[58] Field of Search ..... 24/306, 304, 563, 3 L, 24/597, 517, 489, 370; 248/205.2; 224/247, 252, 269; 211/41

[56] References Cited

U.S. PATENT DOCUMENTS

| | | | |
|---|---|---|---|
| 950,522 | 3/1910 | Vough | 211/41 |
| 1,167,934 | 1/1916 | Roth | 211/41 |
| 1,493,072 | 5/1924 | Fricker | 24/563 |
| 2,166,344 | 7/1939 | Donohue | 24/563 |
| 3,089,211 | 5/1963 | Perusse | 24/259 |
| 3,959,854 | 6/1976 | Lewis | 24/563 |
| 4,158,905 | 6/1979 | O'Leary | 24/81 T |
| 4,591,148 | 5/1986 | Slater | 24/306 |
| 4,708,183 | 11/1987 | Figueroa | 24/306 |
| 4,858,285 | 8/1989 | Dala et al. | 24/555 |
| 4,901,962 | 2/1990 | Greer | 24/555 |
| 4,947,526 | 8/1990 | Fogelman | 24/3 L |
| 4,953,770 | 9/1990 | Bond, Sr. | 224/252 |
| 5,090,095 | 2/1992 | Lightfoot | 24/306 |

*Primary Examiner*—Victor N. Sakran
*Attorney, Agent, or Firm*—John R. Flanagan

[57] ABSTRACT

A clip securement assembly includes a hairpin-shaped clip made of a continuous strip of resiliently flexible flat stock and having an elongated base member, an attachment member and an auxiliary clip member for removable insertion on the top and bottom surfaces of an edge portion of a table top so as to retain a tablecloth thereon. The clip securement assembly also includes a pair of complementary detachable fastening elements for releasably attaching the base member of the clip to a bottom side of an article of dinnerware, such as a plate, for anchoring the plate on the tablecloth on the top surface of the table top. One of the pair of complementary fastening is attached on a terminal end portion of the base member of the clip, while the other of the pair of fastening elements is attachable on the bottom surface of the plate. The fastening elements are aligned and pressed together to anchor the plate firmly to the base member of the clip and thus on the top surface of the table top.

7 Claims, 1 Drawing Sheet

DINNERWARE SECUREMENT ASSEMBLY

BACKGROUND OF THE INVENTION

1. Field of the Invention

The present invention generally relates to picnic table accessories and, more particularly, is concerned with a clip securement assembly for anchoring both a tablecloth and an article of dinnerware to a table top.

2. Description of the Prior Art

Picnics and barbecues are favorite outdoor occasions for bringing friends and families together. Breezy weather, however, can wreak havoc with table settings. Plates can be swept suddenly off tables. Tablecloths can be tossed about by unexpected wind gusts. Therefore, a need arises for a stabilizing device to anchor items such as tablecloths and plates securely on a table.

Some attempts have been made in the prior art to meet these needs. Representative examples of such attempts are disclosed in U.S. Pat. Nos. to Perusse (3,089,211) and O'Leary (4,158,905).

The Perusse device is a clip construction basically comprising a pair of cooperating legs for embracing an edge portion of a table top so as to secure a tablecloth on the table. A child's dish can also be secured thereon by inversion of the legs of the clip such that the lower angular leg is inserted over an edge of the child's bowl on the top surface of the tabletop while the upper straight leg is now inserted along the bottom surface of the tabletop. This type of bowl securement is quite awkward in use, as the angular section of the lower leg protrudes upwardly from the bowl. The optimum use of this structure would probably occur when an adult uses the anchored bowl to feed a young child.

The Perusse device does not address the needs of older children or adults for a plate-anchoring structure which is unobtrusive, easily adaptable to a variety of dishes, and easily detachable therefrom when an additional helping of food is desired by the diner.

The O'Leary device is a bifurcated, double-looped clamp. The basic function performed by this structure is the securement of the tablecloth on the table.

Consequently, a need still exists for a securement device capable of anchoring both a tablecloth and an article of dinnerware to a table top. The device should be simple in design and constructed for inexpensive manufacture and for convenient utilization of the item. Additionally, a simple and sturdy detachability feature must be included on the device. Such feature would permit easy plate detachability from the device by either an adult or older child, for those enjoyable second helpings.

SUMMARY OF THE INVENTION

The present invention provides a clip securement assembly designed to satisfy the aforementioned needs by avoiding the drawbacks of the prior art without introducing other drawbacks. Instead, the assembly of the present invention provides expanded capabilities not available in the prior art devices.

One capability is the simplicity in design and construction of the assembly for inexpensive manufacture and for frequent utilization at outdoor mealtime gatherings. A second capability is the simplicity and sturdiness of the fastening means of the assembly for easy use by both older children and adults to anchor or to remove dinnerware from a table top.

Accordingly, the present invention is directed to a clip securement assembly which comprises: (a) a hairpin-shaped clip having an elongated base member, an attachment member and an auxiliary clip member for removable insertion on the top and bottom surfaces of an edge portion of a table top for retaining a tablecloth thereon; and (b) means for releasably attaching the base member of the clip to a bottom side of an article of dinnerware for anchoring the article of dinnerware on the tablecloth on the top surface of the table top.

The clip is made of a continuous strip of resiliently flexible flat stock, such as strip of spring steel, wherein the base member, attachment member and auxiliary clip member are formed integrally with one another. The base member of the clip is substantially straight in length for contacting the upper surface of the table top along the length of the base member.

The auxiliary clip member has a bendable first portion, a rounded second portion, and a substantially straight terminal portion. The rounded second portion of the auxiliary clip member is for contacting the bottom surface of the table top so as to provide pressurized clamping contact in cooperation with the base member of the clip on the opposite top and bottom surfaces of the table top. The auxiliary clip member normally extends at an acute angle relative to the attachment member of the clip. More particularly, the auxiliary clip member is bendable to a plurality of acute angles and to a right angle relative to the attachment member of the clip for adjusting to a plurality of thicknesses of table tops.

The releasable attaching means of the assembly includes a pair of complementary detachable fastening elements. One of the pair of fastening elements is attached on the base member of the clip while the other fastening element is attachable on the bottom surface of the article of dinnerware. Preferably, the pair of complementary fastening elements are patches of loop and hook detachable fastening materials.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
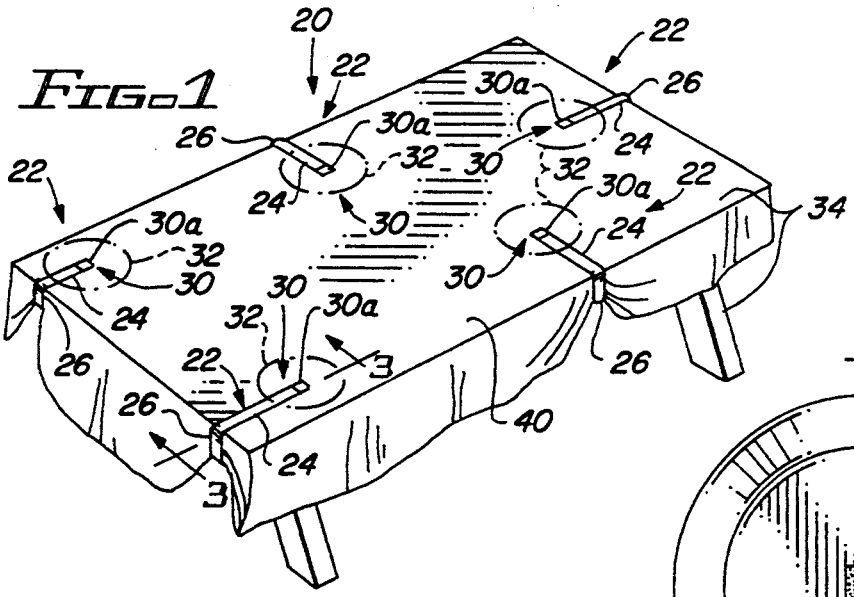
FIG. 1 is a perspective view of a clip securement assembly of the present invention showing a plurality of clips securing a tablecloth to a table top.
Figure 3:
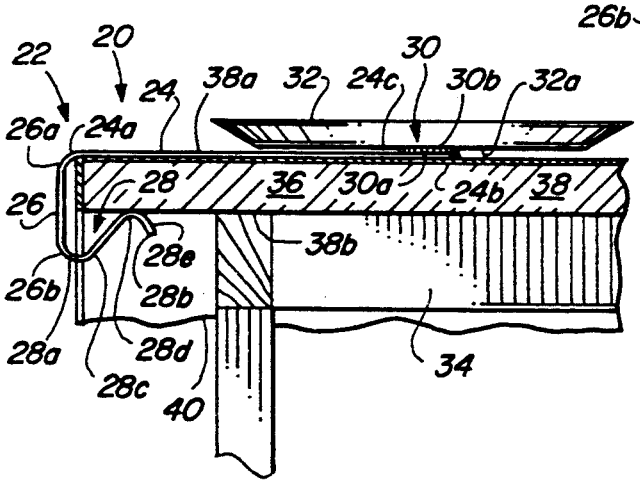
FIG. 3 is a bottom plan view of a plate disposed with a complementary patch of hook or loop fastening materal thereon.

Referring to the drawings and particularly to FIG. 1, there is illustrated a clip securement assembly of the present invention, generally designated 20. In its basic components, the clip securement assembly 20 includes a clip 22 having an elongated base member 24, an attachment member 26 and an auxiliary clip member 28. The clip securement assembly 20 also includes means 30 for releasably attaching the base member 24 to a bottom side 32*a* (FIGS. 3 and 4) of an article of dinnerware 32, for example a dish or plate, for anchoring the plate 32 on the table 34.

Referring to FIGS. 1–4, the base member 24, attachment member 26 and auxiliary clip member 28 of the clip 22 are integrally connected together in a hairpin-shaped configuration for removable insertion over an edge portion 36 of a top 38 of a table 34 such that the base member 24 and auxiliary clip member 28 are removably fitted on the top and bottom surfaces 38*a*, 38*b* of the table top 38 along the edge portion 36. Such insertion of a plurality of clips 22 in spaced relation to one another about the perimeter of the table top 38 releasably secures or retains a tablecloth 40 to the table top 38, as seen in FIG. 1.

Referring to FIGS. 2–6, the clip 22 is made of a continuous elongated strip of resiliently flexible flat stock, such as a strip of spring steel. The base member 24 of the clip extends between its opposite ends 24*a*, 24*b* and is substantially straight throughout its length. When the clip 22 is secured on the table top 38, the base member 24 extends horizontally over the top surface 38*a* so as to make contact with the tablecloth 40 along the entire length of the base member 24.

Figure 2:
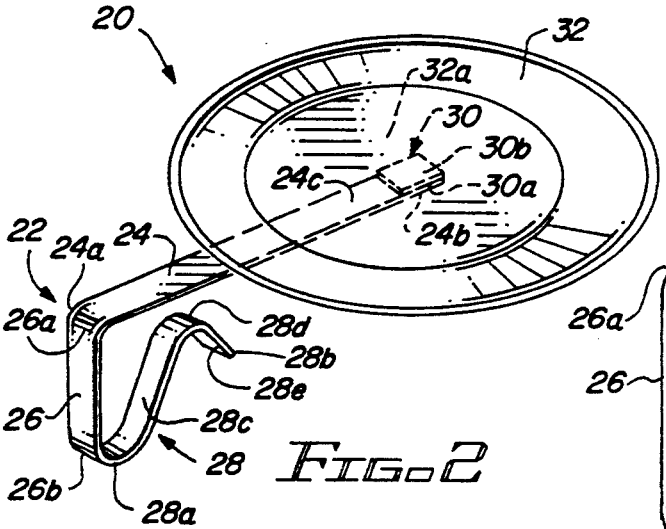
FIG. 2 is a perspective view of the clip securement assembly showing the clip releasably attached to a plate by complementary loop and hook fastening patches.
Figure 4:
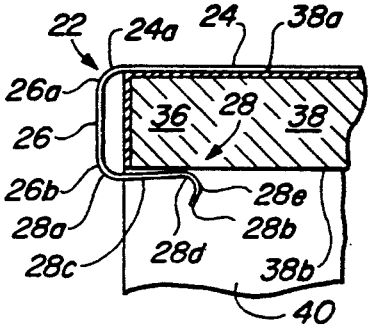
FIG. 4 is an enlarged vertical sectional view taken along line 4—4 of FIG. 1, showing the clip securement assembly mounted on at table top over a tablecloth thereon and releasably fastened to a bottom side of a plate resting on the tablecloth.

The releasable attaching means 30 of the clip securement assembly 10 includes a pair of complementary detachable fastening elements 30*a*, 30*b*. Preferably, the pair of complementary detachable fastening elements 30*a*, 30*b* are patches of loop and hook detachable fastening materials. The detachable loop fastening patch 30*a* is disposed on an upper surface 24*c* of the base member 24 at terminal end 24*b*, as seen in FIGS. 1, 2 and 4. The detachable hook fastening patch 30*b* is centered on a bottom surface 32*a* of the plate 32.

After securement of the clip 22 to the table top 38, the plate 32 can be anchored on the clip 22 by aligning the complementary patches 30*a*, 30*b* over one another and pressing the plate 32 downwardly onto the terminal end 24*b* of the base member 24. The pair of complementary patches 30*a*, 30*b* will mate with one another and thereby detachably secure the plate 32 to the clip 22, as seen in FIGS. 2 and 4.

Referring to FIGS. 2 and 4–6, the attachment member 26 of the clip 22 is substantially straight throughout its length and extends between its opposite ends 26*a*, 26*b*. The base member 24 and attachment member 26 are connected with one another at their respective ends 24*a*, 26*a*. The attachment member 26 merges downwardly and extends generally perpendicularly from the base member 24. The attachment member 26 is thereby positioned vertically adjacent to and outwardly of the edge portion 36 of the table top 38.

The auxiliary clip member 28 of the clip 22 extends between its opposite ends 28*a*, 28*b* and has a bendable first portion 28*c*, a rounded second portion 28*d*, and a substantially straight terminal portion 28*e*. The attachment member 26 is attached to the auxiliary clip member 28 at the bendable first portion 28*c* thereof.

Figure 5:
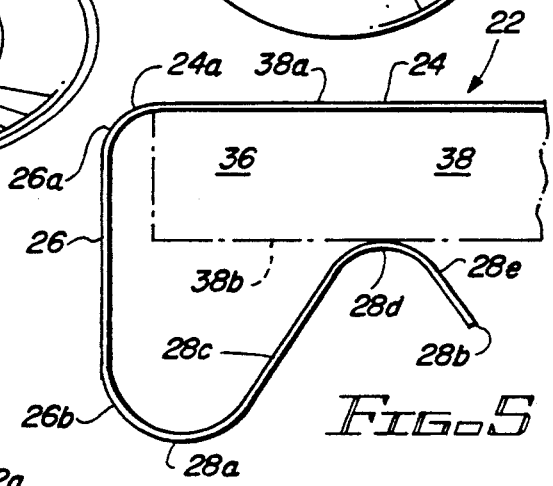
FIG. 5 is an enlarged fragmentary vertical sectional view of the clip mounted on a table top over a tablecloth thereon where the table top has a greater thickness than in FIG. 4.

Referring particularly to FIG. 2, the bendable portion 28*c* of the auxiliary clip member 28 normally extends at an acute angle, such as approximately 45°, relative to the attachment member 26 of the clip 22, prior to securement of the clip 22 to the table top 38. The bendable portion 28*c* is adjustable by bending to any of a plurality of acute angles relative to the attachment member 26, as seen in FIG. 4, and even to a right angle relative to the attachment member 26, as seen in FIG. 5, for adjusting the clip 22 to fit table tops 38 having different thicknesses, as seen in FIGS. 4–6.

Figure 6:
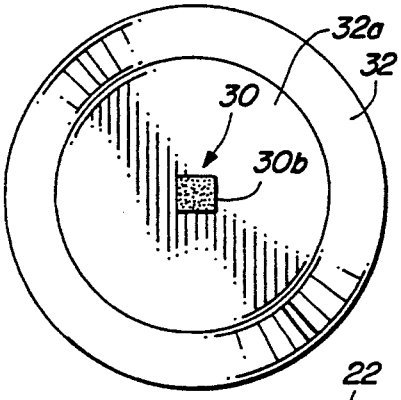
FIG. 6 is an enlarged fragmentary vertical sectional view of the clip shown in FIG. 4.

Referring further to FIGS. 4 and 6, the rounded second portion 28*d* of the auxiliary clip member 28 is disposed adjacent to and merges from the bendable portion 28*c* so as to make contact with the bottom surface 38*b* of the table top 38 as the clip 22 is inserted into place thereon. The rounded portion 28*d* thereby provides pressurized clamping or clasping contact in cooperation with the base member 24 of the clip 22 on the opposite top and bottom surfaces 38*a*, 38*b* of the table top 38.

Referring to FIGS. 2–6, the terminal third portion 28*e*, being substantially straight in length, is disposed adjacent to and merges from the rounded second portion 28*d*. The terminal portion 28*e* extends downwardly in inclined fashion therefrom to end 28*b* so as to provide a camming surface which facilitates insertion of the clip 22 on the edge portion 36 of the table top 38.

As mentioned above, the insertion of a plurality of the clips 22 on or over the edge portion 36 of the table top 38 at spaced locations about its perimeter secures the tablecloth 40 in place on the table 34. The plate 32 can be anchored on the table 34, so as to withstand displacement by normal wind forces, by releasable attachment together of the complementary detachable loop and hook fastening patch 30*a*, 30*b* disposed on upper surface of the clip 22 and the bottom side of the plate 32, respectively. The plate 32 is removable from the clip 22 by lifting the plate slightly upwardly and then laterally away from the base member 24 of the clip 22, thereby detaching the complementary patches 30*a*, 30*b* from one another.

The simplicity of design of the clip securement assembly 20 permits both adults and older children to make frequent use of the device at outdoor mealtime occasions. The clips 22 are compact for easy storage and transport. Further, the complementary loop and hook fastening elements 30*a*, 30*b*, which can be the commercial product known by the trademark Velcro, are individually attached by an adhesive to the base member 24 and plate bottom. A plurality of plates 32, as shown in dashed outline in FIG. 1, can be provided, each with a complementary fastening patch 30*b* thereon, for use with the clip 22.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. Dinnerware securement assembly, comprising:

(a) a clip made of a continuous strip of resiliently flexible flat stock and having an elongated base member, an attachment member and an auxiliary clip member for removable insertion on the top and bottom surfaces of an edge portion of a table top;

(b) an article of dinnerware having a bottom surface; and (c) means for releasably attaching said base member of said clip to said bottom surface of said article of dinnerware to anchor said article of dinnerware on the top surface of the table top, said releasable attaching means including a pair of complementary detachable fastening elements being patches of loop and hook fastening materials, one of said respective patches being attached on a terminal end portion of a top surface of said base member of said clip, the other of said respective patches being attached on said bottom surface of said article of dinnerware.

2. The assembly of claim 1 wherein said clip is made of a continuous strip of spring steel such that said base member, said attachment member and said auxiliary clip member of said clip are formed integrally with one another.

3. The assembly of claim 1 wherein said base member of said clip is substantially straight in length for contacting the upper surface of the table top along the length of said base member.

4. The assembly of claim 1 wherein said auxiliary clip member has a bendable first portion, a rounded second portion, and a substantially straight terminal portion.

5. The assembly of claim 4 wherein said rounded second portion of said auxiliary clip member is for contacting the bottom surface of the table top so as to provide pressurized clamping contact in cooperation with said base member of said clip on the opposite top and bottom surfaces of the table top.

6. The assembly of claim 1 wherein said auxiliary clip member normally extends at an acute angle relative to said attachment member of said clip.

7. The assembly of claim 1 wherein said auxiliary clip member is bendable to a plurality of acute angles and to a right angle relative to said attachment member of said clip for adjusting to a plurality of thicknesses of table tops.

* * * * *